US005310166A

United States Patent [19]

Mast et al.

[11] Patent Number: 5,310,166

[45] Date of Patent: May 10, 1994

[54] SELF-COOLING LANCE OR TUYERE

[75] Inventors: Ernest D. Mast, Montreal; Frank Mucciardi, St. Laurent; Murray J. Brown, Pointe-Claire, all of Canada

[73] Assignee: Noranda, Inc., Toronto, Canada

[21] Appl. No.: 929,748

[22] Filed: Aug. 17, 1992

[30] Foreign Application Priority Data

Aug. 23, 1991 [CA] Canada ..... 2049774

[51] Int. Cl.[5] ..... F27D 3/16

[52] U.S. Cl. ..... 266/225; 266/265

[58] Field of Search ..... 266/225, 265

[56] References Cited

U.S. PATENT DOCUMENTS 3,378,366 4/1968 Borowski et al. ..... 266/225
3,488,044 1/1970 Shepherd ..... 266/225
3,615,085 10/1971 Bernsmann ..... 266/225
3,912,244 10/1975 Chang ..... 266/225

*Primary Examiner*—Scott Kastler
*Attorney, Agent, or Firm*—Keck, Mahin & Cate

[57] ABSTRACT

A self-cooling lance or tuyere for the conveying of gases, liquids or solids into or onto a metallurgical bath comprises a heat pipe or thermosiphon made of two tubular members adapted to be immersed in a furnace environment at one end, such tubular members defining a closed annular chamber therebetween for containing a working substance adapted to evaporate in the region of the heat pipe which is in the furnace environment and flow toward the end which is out of the hot environment where it condenses and flows back to the evaporator region. Means are provided for introducing the gases, liquids or solids to be conveyed into the bath through the inner tubular member of the lance.

5 Claims, 1 Drawing Sheet

SELF-COOLING LANCE OR TUYERE

This invention relates to a self-cooling lance, tuyere, pipe or other tubular member for the conveying of gases, liquids or solids into or onto a metallurgical bath or related melt.

Current technology for the conveying of gases, liquids or solids into metallurgical vessels utilizes fluid cooled lances (water cooled in particular), monolithic and composite lances, and lances employing a mechanism that swirls the gases within the lance. Water cooled lances are complicated in design, consisting of a plurality of chambers and tubes. They pose a safety hazard, due to the presence of large circulating flows of water in close proximity to a high temperature bath, making them unsuitable for continuous use in an immersed application. Monolithic lances made of metals, ceramics or refractory clad metals are known to progressively wear away from the tip very rapidly or to have the submerged portion fail. Lances employing a swirling mechanism are relegated to use in molten slag, with injection into other types of metallurgical melts being too severe an application, resulting in rapid consumption of the lance.

The object of this invention is to provide a self-cooling lance or tuyere, based on current heat pipe/thermosiphon technology, which is able to operate as required in a metallurgical environment. Another object is to provide a lance so that if there is a failure, there would be a minimal safety hazard.

The self-cooling lance or tuyere in accordance with the present invention generally comprises a heat pipe or thermosiphon made of two tubular members defining a closed annular region for a working substance, the inner tube member being the channel by which the feed materials are conveyed into or onto the metallurgical bath.

Those familiar in the art of heat pipes will know that a heat pipe or thermosiphon uses a material known as a working substance that is contained in a hermetically sealed vacuum. As heat is supplied to the working substance, it evaporates and its vapour flows to the cooler end of the heat pipe where it condenses as a liquid and flows back to the evaporator end of the heat pipe to repeat the cycle. The choice of working substance is dependent upon the application. For example, an application that requires a lance temperature of 850° C. in an environment at 1200° C. would have sodium (boiling point=882.9° C.) as a working substance candidate. Working substances for lower temperature applications include selenium, potassium, cesium, sulphur, sodium, and mercury. Working substances for higher temperature applications include zinc, magnesium, lithium, and silver. After selection of the working substance, the pipe materials may be chosen. The amount of working substance used depends on the lance dimensions but a maximum would be in the order of a few kilograms. A heat pipe/thermosiphon in a vertical position, utilizing gravity to return the working substance to the evaporator, is properly termed a thermosiphon. If other forces, such as capillary, return the working substance the correct term is a heat pipe.

Heat is transferred via the latent heats of evaporation and condensation of the working fluid. The heat pipe attains a very high effective thermal conductivity and the result is that the evaporator and condenser regions achieve a near uniform temperature in between the heat source and the ambient.

A lance utilizing heat pipe technology would preferably be made by creating an annular region between two concentric pipes using a washer shaped piece at each end of the concentric tubes. The annular region may also be defined by one or both of the tubular members having a non-circular geometry. As well, the outer member may be sectioned, while maintaining a closed annular region, so that the diameter of the condenser region is greater than that of the evaporator. If the inner and outer members were to experience differing linear thermal expansion during operation, an expansion joint of suitable design, may be integrated into the upper part of the condensing section. The inner pipe may be extended at the gas, liquid or solid entrance to ameliorate coupling of the gas, liquid or solid sources with the lance. When the lance is inserted into a furnace, the annular portion of the lance which is in the furnace acts as an evaporator and the portion removed from the furnace acts as the condenser. The lance achieves a temperature in between the furnace and ambient temperatures. The temperature at which steady state is achieved is a function of a) the heat transfer into the lance as per the application, b) the physical properties of the working substance, c) the thermal conductivity of the pipes, d) the gas flowrate down the inner pipe, e) the ratio of surface areas between the evaporator and condenser sections, f) the heat transfer from the condenser according to the ambient conditions, and g) the vacuum in the annular region.

Once the lance is constructed it is possible to adjust the temperature during operation, without affecting the process, by the adjustment of parameters e, f and g. The ratio of the evaporator to condenser areas can be controlled by insulating a part of the condenser. Heat transfer from the condenser may be increased by air or water cooling. The vacuum in the annular region may be adjusted.

Measurements from a pressure transducer of the vapour pressure of the working substance in the annular region can give an indication of the vapour temperature and thus the lance temperature. The lance would be designed so that the vapour pressure of the working substance would be less than one atmosphere and thus pose a minimal risk.

An amount of inert gas, present in the annular region, will oppose the working substance vapour. Its pressure may be adjusted via a connection to a gas supply or a vacuum pump. Its function is to be forced to the furthest portion of the lance from the evaporator so that such region does not participate in the evaporation and condensation of the working substance. Thus this region remains at a near ambient temperature and thus protects the said pressure transducer from heat failure.

If a heat pipe lance is used in a non vertical position capillary forces aid in the fluid return. To fully utilize capillary forces, a wick material coating the outer surface of the inner pipe and the inner surface of the outer pipe, well described in the art of heat pipes, is required to ensure that the working substance coats the entire surface area.

Lance failure could occur in the furnace environment. However, the small quantities of working substance, its elevated operating temperature, and its relatively high boiling point precludes the possibility of a safety hazard resulting from contact of the working substance with the molten charge in the furnace. Furthermore, by designing the lance so that the vapour pressure in the annular region is less than one atmosphere, lance failure would result in materials being drawn into the annular region, rendering the working substance harmless.

BRIEF DESCRIPTION OF THE DRAWINGS

The invention will now be disclosed, by way of example, with reference to the accompanying drawings in which.

Figure 1:
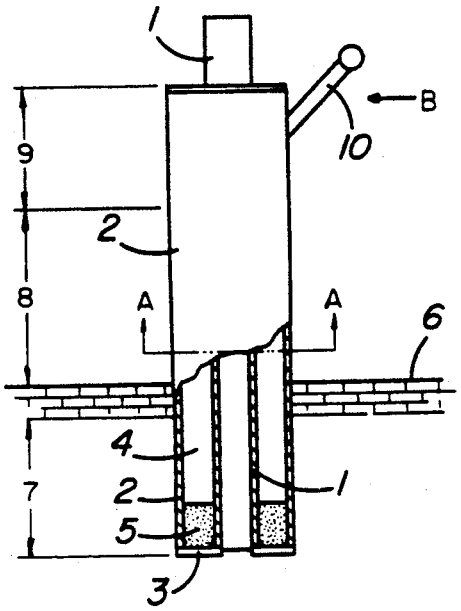
FIG. 1 is a diagram of a heat pipe/thermosiphon lance with a cutaway view showing its cross section in the vertical plane.
Figure 2:
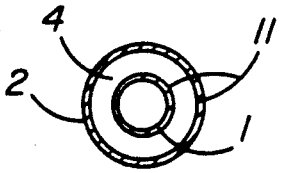
FIG. 2 is a view taken along lines A—A of FIG. 1.
Figure 3:
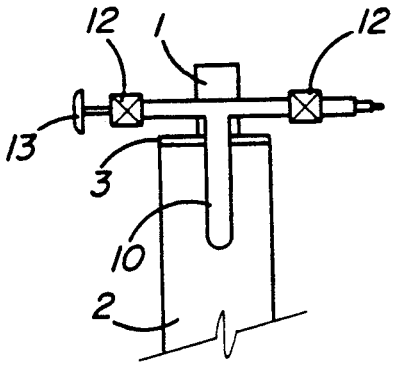
FIG. 3 is a view of FIG. 1 in the direction of arrow B.

The lance or tuyere is made of two concentric pipes 1 and 2 which are closed at each end by a washer piece 3 defining a closed annular chamber 4 containing a working fluid 5. The process gases, liquids or solids are injected into the inner pipe 1, which is extended from the outer pipe 2, to aid in the coupling of a source of the process gases, liquids or solids into the inner pipe 1. The lance is inserted through the furnace roof 6 a certain length 7. The working fluid 5, in the annular region 4, evaporates in the evaporator region 7 of the heat pipe and flows to region 8, in the orientation of FIG. 1 it rises. The vapour condenses along the inner wall of the outer pipe 2 and the outer wall of the inner pipe 1 in the condenser portion of the lance. The liquid from the condensation flows back to the evaporator section 7 and the cycle continues. The inner surface of the outer pipe and the outer surface of the inner pipe may be coated with a wick material 11 to aid fluid flow to the evaporator. Furthest from the evaporator, there may be a portion 9 where inert gas is accumulated and at a temperature lower than the condenser.

A tube 10 is welded onto the outside of the outer tube 2, where a hole has been drilled to allow the charging of the working substance 5. The tube is branched with both ends attached to valves 12. The valves are followed by a nipple or fitting for hook-up to a vacuum pump (not shown) for changing the vacuum in the annular region, and a pressure transducer 13, to measure the vapour pressure of the working fluid in the annular region in the lance. The valves and pressure transducer must be located above the washer piece 3.

The invention will now be disclosed, by way of example, with reference to tests performed with the following heat pipe.

TABLE 1

| Heat Pipe Lance | |
|---|---|
| Length | 1.02 m |
| Material | 316L Stainless Steel |
| Inner Pipe | 0.3175 cm ID, 0.635 cm OD |
| Outer Pipe | 2.66 cm ID, 3.34 cm OD |
| Working Substance | 30 g Sodium |
| Vapour Pressure at 25° C. | 0.0286 atm |

A 30.5 cm length was inserted into a resistance furnace at 1200° C. The steady state lance temperature was 800° C., 400° C. less than the furnace. The vapour pressure was 1.30 atm and the condenser length was 37 cm. The lance was tested at other conditions, a few of which are shown in Table 2.

TABLE 2

| Heat Pipe Lance at Various Conditions | | | | | |
|---|---|---|---|---|---|
| Furnace Temp. (°C.) | Inner Pipe Gas Flow (Lpm) | Gas Flow Over Condenser (m/s) | Lance Vapour Pres. (atm) | Lance Temp. (°C.) | Condenser Length (cm) |
| 1200 | 0 | 0 | 1.30 | 800 | 37 |
| 1200 | 50 | 0 | 0.96 | 773 | 35 |
| 1200 | 0 | 9.5 | 0.74 | 660 | 29 |
| 1250 | 0 | 0 | 1.56 | 820 | 43 |

The tests showed that increasing the heat transfer from the lance by blowing air through the inner pipe or by blowing air over the condenser surface decreased the lance temperature, sodium vapour pressure and condenser length. Increasing the furnace temperature increased the lance temperature, sodium vapour pressure, and condenser length.

Although the invention has been disclosed with reference to a preferred embodiment, it is to be understood that various alternatives are also envisaged within the scope of the following claims.

We claim:

1. A self-cooling lance or tuyere for the conveying of gases, liquids or solids into or onto a metallurgical bath comprising a heat pipe or thermosiphon made of two tubular members, the heat pipe having one end inside a furnace environment and the other end outside the furnace environment, said tubular members defining a closed annular chamber therebetween, the chamber containing a working substance adapted to evaporate in a region of the heat pipe which is inside the furnace environment and flow toward the end of the heat pipe which is outside the furnace environment where the working substance condenses and flows back to the evaporator region, the self cooling lance or tuyere further comprising a tube connected to the outer tubular member for charging the working substance into the closed annular chamber, and means for measuring the vapor pressure of the said working substance to determine the temperature of the lance or tuyere.

2. A self-cooling lance or tuyere for the conveying of gases, liquids or solids into or onto a metallurgical bath comprising a heat pipe or thermosiphon made of two tubular members, the heat pipe having one end inside a furnace environment and the other end outside the furnace environment, said tubular members defining a closed annular chamber therebetween, the chamber containing a working substance adapted to evaporate in a region of the heat pipe which is inside the furnace environment and flow toward the end of the heat pipe which is outside the furnace environment where the working substance condenses and flows back to the evaporator region, the self cooling lance or tuyere further comprising a tube connected to the outer tubular member for charging the working substance into the closed annular chamber, and means for connecting said tube to a vacuum pump to control vapor pressure in the annular chamber.

3. A self-cooling lance or tuyere for the conveying of gases, liquids or solids into or onto a metallurgical bath comprising a heat pipe or thermosiphon made of two tubular members, the heat pipe having one end inside a furnace environment and the other end outside the furnace environment, said tubular members defining a closed annular chamber therebetween, the chamber containing a working substance adapted to evaporate in a region of the heat pipe which is inside the furnace environment and flow toward the end of the heat pipe which is outside the furnace environment where the working substance condenses and flows back to the evaporator region, the self cooling lance or tuyere further comprising a wick material covering the walls of the annular chamber to facilitate return of the working substance to the evaporator region when the heat pipe is used in a non vertical position.

4. A self-cooling lance or tuyere for the conveying of gases, liquids or solids into or onto a metallurgical bath comprising a heat pipe or thermosiphon made of two tubular members, the heat pipe having one end inside a furnace environment and the other end outside the furnace environment, said tubular members defining a closed annular chamber therebetween, the chamber containing a working substance adapted to evaporate in a region of the heat pipe which is inside the furnace environment and flow toward the end of the heat pipe which is outside the furnace environment where the working substance condenses and flows back to the evaporator region, and further comprising cooling means around the end of the heat pipe outside of the furnace.

5. A self-cooling lance or tuyere for the conveying of gases, liquids or solids into or onto a metallurgical bath comprising a heat pipe or thermosiphon made of two tubular members, the heat pipe having one end inside a furnace environment and the other end outside the furnace environment, said tubular members defining a closed annular chamber therebetween, the chamber containing a working substance adapted to evaporate in a region of the heat pipe which is inside the furnace environment and flow toward the end of the heat pipe which is outside the furnace environment where the working substance condenses and flows back to the evaporator region, and wherein the working substance is mercury, sulphur, cesium, potassium, selenium, sodium, zinc, magnesium, lithium, silver.

* * * * *